United States Patent [19]

Herrmann et al.

[11] 4,410,332

[45] Oct. 18, 1983

[54] PROCESS FOR THE LEVEL DI- AND TRICHROMATIC DYEING OF POLYACRYLONITRILE MATERIALS WITH MIGRATING AND NON-MIGRATING CATIONIC DYES

[75] Inventors: Manfred Herrmann, Steinbach, Fed. Rep. of Germany; Rico Jenny; Manfred Motter, both of Basel, Switzerland

[73] Assignee: Ciba-Geigy Corporation, Ardsley, N.Y.

[21] Appl. No.: 344,466

[22] Filed: Feb. 11, 1982

[30] Foreign Application Priority Data

Feb. 4, 1981 [CH] Switzerland ..... 742/81

[51] Int. Cl.[3] ..... D06P 3/76

[52] U.S. Cl. ..... 8/644; 8/638; 8/927

[58] Field of Search ..... 8/644, 638

[56] References Cited

U.S. PATENT DOCUMENTS

| | | | |
|---|---|---|---|
| 3,107,968 | 10/1963 | Pascal | 8/539 |
| 3,945,793 | 3/1976 | Corbishley et al. | 8/539 |
| 4,097,233 | 6/1978 | Takahashi et al. | 8/539 |
| 4,116,622 | 9/1978 | Koller et al. | 8/644 |
| 4,123,222 | 10/1978 | Loew | 8/654 |
| 4,181,499 | 1/1980 | Koller et al. | 8/568 |

FOREIGN PATENT DOCUMENTS

| | | |
|---|---|---|
| 52/37885 | 3/1977 | Japan . |
| 1355102 | 5/1974 | United Kingdom . |
| 2001092 | 1/1979 | United Kingdom . |

*Primary Examiner*—A. Lionel Clingman

*Attorney, Agent, or Firm*—Edward McC. Roberts

[57] ABSTRACT

A process is described for the level di- and trichromatic dyeing of polyacrylonitrile materials or of blends containing polyacrylonitrile, which process comprises using for the dyeing an aqueous dyeing liquor which contains at least two dye mixtures, each dye mixture consisting of at least (a) one migrating cationic dye, the cation weight of which is less than 310, the parachor of which is less than 750 and the log P of which is less than 3.6, and (b) at least one non-migrating cationic dye, at least one parameter of which is outside the definition given under (a), and the components (a) and (b) being employed in a mixing ratio which is such that during the dyeing process the migrating and non-migrating dyes migrate on the fibre on tone. This produces, on polyacrylonitrile materials, dyeings which are distinguished by high levelness and high lightfastness.

9 Claims, No Drawings

PROCESS FOR THE LEVEL DI- AND TRICHROMATIC DYEING OF POLYACRYLONITRILE MATERIALS WITH MIGRATING AND NON-MIGRATING CATIONIC DYES

The invention relates to a process for the level di- and trichromatic dyeing of polyacrylonitrile materials with specific dye combinations and also to the dyed material and to the dye combinations per se.

Cationic dyes developed specifically for the dyeing of polyacrylonitrile fibres are in general distinguished by a high affinity and build-up capacity, a high fastness level and also by a brilliant shade. However, their migration capacity on most substrates of polyacrylonitrile fibre material is only low at the boil (98° to 100° C.). This has the consequence that unlevelness arises which results due to the high exhaustion rate of these dyes during the exhaustion process; this unlevelness can be remedied only under conditions which run counter to the productivity of a dye house or to preserving the appearance of the textile structure, for example, by prolonging the boil phase or by increasing the dyeing temperature considerably.

To avoid these "unlevelness" difficulties various dyeing processes have been developed which, however, all have the disadvantage that they must be adapted to the polyacrylonitrile fibre type, the type of material, the equipment-related conditions, the exhaustion rate of the dyes used and also to the depth of shade. They aim at extending the exhaustion process, either by a slow heating-up phase or by the addition of considerable amounts of cationic or anionic retarders. However, the disadvantage pointed out has never been completely remedied.

German Auslegeschrift No. 2,548,009 then proposed to add to the dyebath instead of conventional cationic dyes special cationic dyes which have a certain migration capacity and which are characterised by certain parameters, such as cation weight, parachor and log P. Although the use of these special migrating cationic dyes leads to the desired result in respect of levelness, the lightfastness properties are not satisfactory by comparison with those which are achieved with conventional cationic dyes.

The object of the invention was therefore to produce, on polyacrylonitrile material or blended fabrics containing polyacrylonitrile, in a rapid and fault-free manner, dyeings which are not only level but also fast to light, with the exclusion of all the disadvantages mentioned.

This object is achieved by dyeing polyacrylonitrile material or blended fabrics containing polyacrylonitrile with an aqueous dyeing liquor which contains a combination of at least two dye mixtures, each of which consists of at least one migrating cationic and at least one non-migrating cationic dye which together migrate on tone.

As will be defined in more detail in the text which follows, non-migrating cationic dyes are to be understood here as meaning those dyes which, although they do migrate to a small extent, have a limited migration capacity. On dyeing polyacrylonitrile materials with these dyes, any initial unlevelness which may arise is no longer levelled up during the boil phase.

The process according to the invention thus relates to a process for the level di- and trichromatic dyeing of polyacrylonitrile materials, which process comprises using for the dyeing an aqueous dyeing liquor which contains at least two dye mixtures, each dye mixture consisting of at least (a) one migrating cationic dye, the cation weight of which is less than 310, the parachor of which is less than 750 and the log P of which is less than 3.6, and (b) one non-migrating cationic dye, at least one parameter of which is outside the definition given under (a), and the components (a) and (b) being employed in a mixing ratio which is such that during the dyeing process the migrating and non-migrating dyes migrate on the fibre on tone.

The dye component (a) can be not only a single dye but also a mixture of migrating cationic dyes of the type defined. The same applies to the dye component (b) which is likewise a single dye or a mixture of cationic dyes.

The aqueous dyeing liquor additionally contains at least one electrolyte and also, if desired, other additives which are customary in dyeing, and/or retarders.

One advantage of the process according to the invention is that exhaustion unlevelness can be tolerated since it is levelled up within the dyeing time (about 30 to 45 minutes at 102° to 104° C.). This yields further advantages, such as, in particular, a shortened heating-up phase (to raise the bath temperature from 80° to 100° C., 20 to 25 minutes, and no longer 45 to 90 minutes, are required).

Furthermore, no addition or only a very small addition (0.01 to 3% by weight) of a cationic retarder is required; this produces a cost saving in addition to ecological benefits.

It is of particular importance that the process according to the invention produces, on polyacrylonitrile materials, dyeings having a very high lightfastness.

Finally, a further advantage of the process according to the invention is that dyeings which nevertheless have an unlevel result can be levelled up without difficulty by prolonged boiling.

The process according to the invention makes it possible to produce, on any polyacrylonitrile material, level solid dyeings in all possible shades. Of critical importance for the success of the dyeing process according to the invention is the mixing ratio of the dye components (a) and (b) used in each of the dye mixtures. The mixing ratio can vary within wide limits, an example being that 2 to 98% of the dye component (a) and 98 to 2% of the dye component (b) are present.

Preferably, 20 to 80% of the dye component (a) and 80 to 20% of the dye component (b) are used. However, those dye mixtures are particularly preferable which contain component (b), i.e. the non-migrating dye portion, in excess. The mixing ratio is essentially determined by the migration capacity of the individual dyes.

The mixing ratio of the dye mixtures, each of which consists of the components (a) and (b), employed for the di- and trichromatic dyeing is in turn subject to the conditions that 1. in each case the same percentage of the total amount of dye migrates under identical conditions (for example 98° to 105° C.) and
2. the migration of the individual dye mixtures is in each case on tone.

The dyeing process according to the invention or results which can be achieved by means of the dye combinations according to the invention, respectively, are surprising. For example, certain brown dye combinations prepared from a mixture A consisting only of migrating dyes in accordance with (a) and from a mixture B consisting only of non-migrating dyes in accordance with (b) do not produce a level, brown dyeing.

Migrating cationic dyes are those which have a more or less delocalised positive charge, the cation weight of which is less than 310, in particular less than 275, the parachor of which is less than 750, in particular less than 680, and the log P of which is less than 3.6, in particular less than 2.8. The parachor used here is calculated in accordance with the article by O. R. Quayle Chem. Rev. 53, 439 (1953); and log P denotes relative lipophilicity, the calculation of which has been described by C. Hansch et al. J. Med. Chem. 16, 1207 (1973). This calcuation did not take into account the influence of the charge of dye cations, which produces log P values which are higher by about 6 log units. The cationic migrating and non-migrating dyes can belong to various dye classes. They are in particular salts, for example chlorides, sulfates, methosulfates, acetates or metal halides, for example zinc chloride salts of azo dyes, such as monoazo dyes or hydrazone dyes, diphenylmethane, methine or azomethine dyes, ketonimine, cyanine, azine, oxazine or thiazine dyes.

Particularly good results in respect of the levelness and light-fastness of dyed polyacrylonitrile materials are obtained on using the following dye mixtures:

| | Cation weight | Parachor | log P |
|---|---|---|---|
| I. Yellow: Dye mixture of | | | |
| 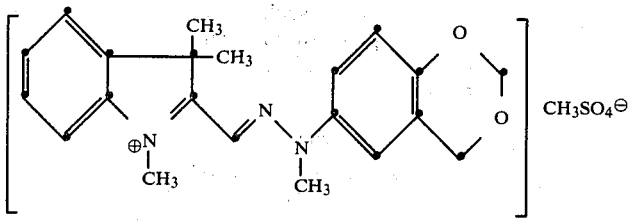 | 350 | 740 | 5.21 |
| 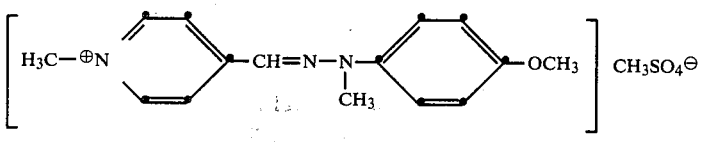 | 256 | 618 | 2.49 |
| 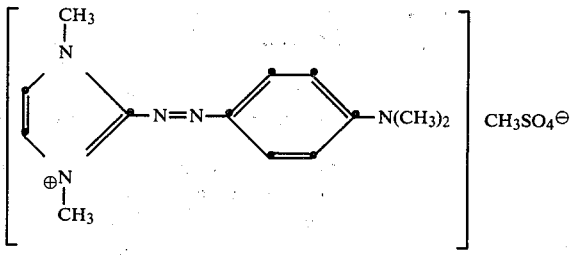 | 244 | 610 | 2.68 |
| II. Blue: Dye mixture of | | | |
| 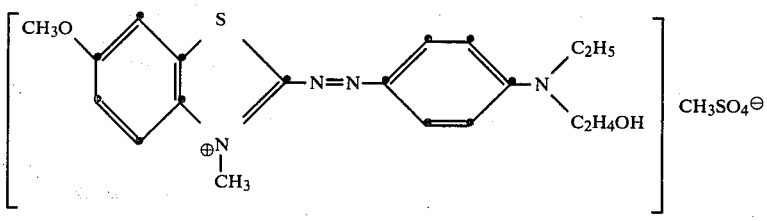 | 371 | 817 | 3.84 |
| 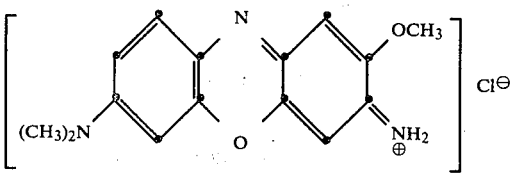 | 270 | 577 | 1.97 |

-continued

| | Cation weight | Para-chor | log P |
|---|---|---|---|
| 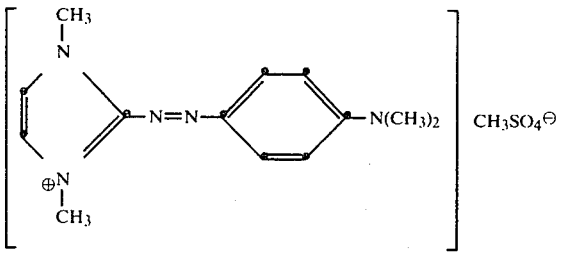 | 244 | 610 | 2.68 |
| III. Red: Dye mixture of | | | |
| 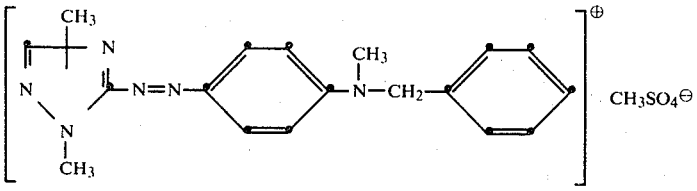 | 321 | 764 | 3.22 |
| 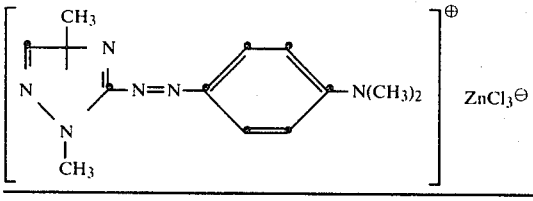 | 245 | 620 | 1.57 |

The dye mixtures according to the invention provide a balanced di- and trichromatic system of cationic dyes which have a very high capacity for migration and excellent light-fastness and which make it possible to dye in a simple and reliable manner.

Cationic retarders which can be added to the dyebath must have a migration capacity which is comparable to that of the dye mixtures of (a) and (b), since otherwise the retarder which has exhausted unlevelly and has become wellbonded leads to unlevel dyeings which cannot be corrected. Examples of possible retarders are:

Organic ammonium compounds which have a higher alkyl radical and are of the general formula I

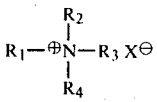

(I)

in which $R_1$ is an unsubstituted alkyl group having 8 to 14, preferably 8 to 12, carbon atoms, $R_2$ and $R_3$ independently of one another each are hydrogen, a lower alkyl radical which is unsubstituted or substituted by hydroxyl groups, or lower alkoxy groups or cyano groups, a cycloalkyl radical or a polyglycol ether chain having 2 to 4 alkyleneoxy groups, or $R_2$ and $R_3$, together with the nitrogen atom linking them, are a piperidine or morpholine ring, $R_4$ is hydrogen, a lower alkyl radical which is unsubstituted or substituted by hydroxyl groups or lower alkoxy groups or an aralkyl radical, and $X^{\ominus}$ is the anion of an organic or inorganic acid; those substances of the formula I are particularly preferable in which $R_1$ is an unsubstituted $C_8$–$C_{12}$-alkyl radical, $R_2$ and $R_3$ are methyl or ethyl and $R_4$ is a benzyl radical.

Furthermore, compounds of the general formula II

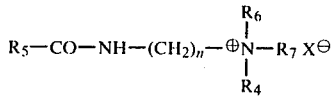

(II)

in which $R_4$ and $X^{\ominus}$ have the meaning indicated, $R_5$ is an unsubstituted alkyl group having 7 to 17 carbon atoms, $R_6$ and $R_7$ are each an unsubstituted lower alkyl group, and n is 2 or 3, can be used.

Likewise suitable compounds are cationic organic ammonium compounds which have at least one higher alkyl radical and are of the general formula III

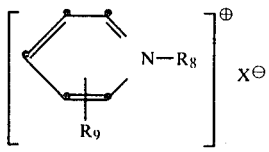

(III)

in which $R_8$ is an alkyl chain having 8 to 18, preferably 8 to 12, carbon atoms which is uninterrupted or interrupted by oxygen atoms and is not further substituted, $R_9$ is hydrogen, a methyl group or an ethyl group, and $X^{\ominus}$ has the meaning indicated, and compounds of the general formula IV

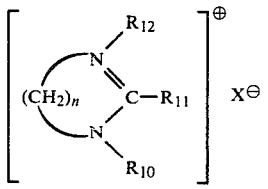

(IV)

in which one R out of $R_{10}$, $R_{11}$ and $R_{12}$ is an unsubstituted alkyl group having 7 to 18 carbon atoms and the two other R's are hydrogen or a lower alkyl radical which is unsubstituted or substituted by hydroxyl groups, n is the number 2 or 3, and $X^{\ominus}$ has the meaning indicated, and compounds of the general formula V

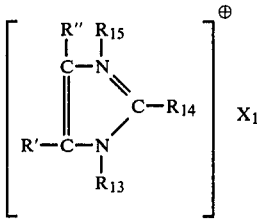

(V)

in which $R_{13}$ is an unsubstituted alkyl group having 8 to 18 carbon atoms, $R_{14}$ is hydrogen, an unsubstituted alkyl group having up to 18 carbon atoms or an unsubstituted phenyl radical, $R_{15}$ is an unsubstituted lower alkyl group or a benzyl radical, and $X_1^{\ominus}$ is the anion of hydrochloric or hydrobromic acid or of methosulfuric acid, and R' and R" independently of one another are hydrogen, an unsubstituted alkyl group having up to 12 carbon atoms or they form together with the carbon atoms linking them a substituted or unsubstituted benzene ring.

Further suitable compounds have the general formula VI

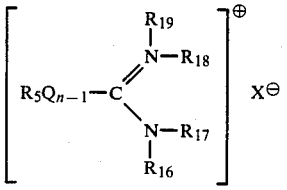

(VI)

in which $R_5$ is an unsubstituted alkyl group having 7 to 17 carbon atoms, Q is $S.NR_{20}$ or O, $R_{16}$, $R_{17}$, $R_{18}$, $R_{19}$ and $R_{20}$ independently of one another are each hydrogen, a lower alkyl radical which is unsubstituted or substituted by hydroxyl groups or by lower alkoxy groups, a cycloalkyl group or an aralkyl group, $X^{\ominus}$ is the anion of an organic or inorganic acid, and n is 1 or 2.

Particularly suitable retarders are those of the formula VII

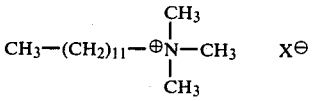

(VII)

with a cation weight of 228, a parachor of 665 and a log P of 6.68, those of the formula VIII

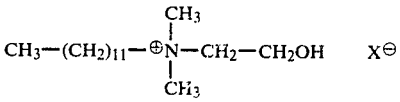

(VIII)

with a cation weight of 258, a parachor of 744 and a log P of 5.65, and also those of the formula IX

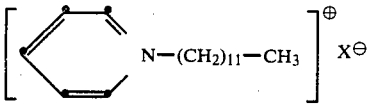

(IX)

with a cation weight of 248, a parachor of 693 and a log P of 6.32, $X^{\ominus}$ being the anion of an organic or inorganic acid.

The addition of a retarder has the effect that the dyeing rate of cationic dyestuffs is reduced. The use of the dye mixture, to be used according to the invention, of (a) and (b) and of retarders makes it possible to save about 50 to 100% of the retarder quantity compared with hitherto customary processes.

The amounts in which dye combinations to be used according to the invention and, if desired, retarders are employed in dyebaths can vary within wide limits according to the depth of shade desired; in general, dye quantities total 0.01 to 5, preferably 0.01 to 2, and also advantageous retarder additions are 0.01 to 3, preferably 0.1 to 1.0, percent by weight of one or more of the retarders mentioned, based on the weight of the polyacrylonitrile material.

The dyeing liquor also contains electrolytes, such as sodium salts, for example sodium chloride, sodium sulfate or sodium nitrate; ammonium salts, such as ammonium chloride or ammonium sulfate; potassium salts, such as potassium chloride or potassium sulfate, and/or tetramethylammonium salts, such as, for example, tetramethylammonium chloride. These electrolytes are used in amounts of 1 to 10, preferably 5 to 10, percent by weight, based on the material to be dyed.

In addition, still other additives which are customary in dyeing, for example formic acid, acetic acid or sulfuric acid, and also compounds required to stabilise a certain pH value, for example the acetate, citrate or phosphate of sodium, potassium or ammonium, can also be present in the dyeing liquor.

The process according to the invention, which has the great advantage that it need not be adapted to a certain polyacrylonitrile fibre type but can be used for all cationically dyeable types, is preferably carried out by the exhaustion method. Because the migration of the dye combinations is very high, during the exhaustion phase of the dyes a certain amount of unlevelness, caused, for example, by a considerably shortened heating-up phase, is quite permissible, as has been pointed out. However, this resulting unlevelness must amount to no more than can be levelled up at the dyeing temperature (95° to 120° C.) as well as in a normal period at the boil (45 to 60 minutes).

The procedure used according to the invention is to put the polyacrylonitrile dyeing goods at a temperature of about 80° C. into a dyebath which has been charged with the necessary additives and which is then heated in the course of 15 to 30 minutes to 100° to 104° C., left at this temperature for about 30 to 45 minutes and thereafter cooled down.

-continued

Dye mixture I:

| Dye | Cation weight | Para-chor | log P |
|---|---|---|---|
| 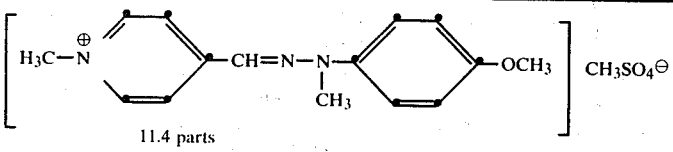 11.4 parts | 256 | 618 | 2.49 |
| 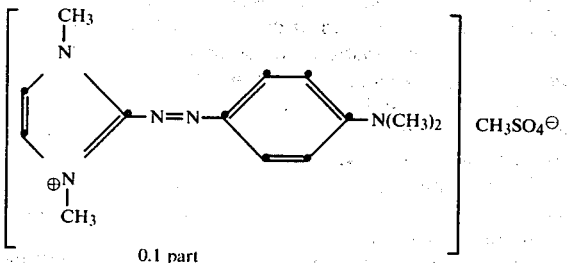 0.1 part and also 70.5 parts of sodium sulfate (anhydrous) | 244 | 610 | 2.68 |

Dye mixture II:

| Dye | Cation weight | Para-chor | log P |
|---|---|---|---|
| 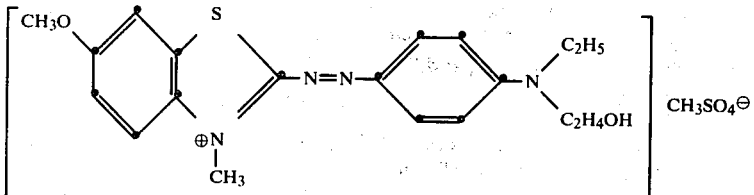 14 parts | 371 | 817 | 3.84 |
| 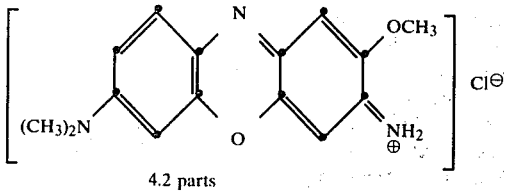 4.2 parts | 270 | 577 | 1.97 |
| 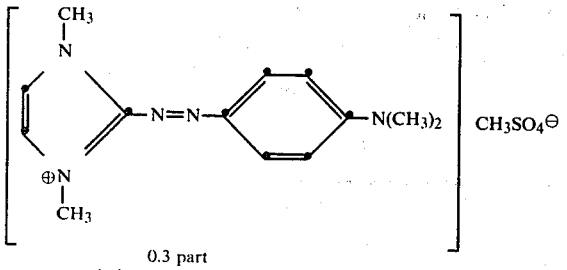 0.3 part and also 81.5 parts of sodium sulfate (anhydrous) | 244 | 610 | 2.68 |

The procedure described in Example 1 is repeated, except that the percentages of dye mixtures given in Table 1, which follows, are used in place of 0.72% of dye mixture I and 0.55% of dye mixture II, affording the shades on polyacrylonitrile yarn (PAN) indicated in the same table:

TABLE 1

| Example No. | Dye mixture I in % | Dye mixture II in % | Shade on PAN |
|---|---|---|---|
| 2 | 1.05 | 0.17 | yellowish-tinged green |
| 3 | 0.2 | 1.15 | greenish-tinged blue |

The process according to the invention can be used, as mentioned, for all cationically dyeable fibre types of polyacrylonitrile and also for rapid-dyeing, normal-dyeing or slow-dyeing polyacrylonitrile fibres. Polyacrylonitrile fibres mainly consist of about 85% of an acrylic part and about 15% of a copolymer part. Blend yarns containing polyacrylonitrile and, for example, cellulose, polyester or polyamide, can also be dyed according to the invention.

These polyacrylonitrile fibre materials can be made up in a wide variety of ways; possible examples are loose material, slubbing, tow, yarn in the form of hanks, cross-wound bobbins, warp beam, muffs, wound packages, woven and knitted goods and carpets, but especially the dyeing of cross-wound bobbins and piece dyeing for the furnishings sector.

The liquor ratio (ratio of 1 kg of goods to 1 liter of liquor) depends on equipment-related circumstances, the substrate and the way in which the material is made up and also on the package density. It varies within a wide range, but it is usually between 1:5 and 1:40.

The process according to the invention thus permits the production of level and light-fast mixture shade dyeings under HT conditions (102° to 105° C.) with the use of specifically selected dye mixtures of cationic dyes. It is a simple dyeing process which does not depend on the polyacrylonitrile fibre type to be dyed and in which shorter heating-up times are possible than when using non-migrating cationic dyes, perfectly level dyeings obtained nevertheless. This process requires no or only very small amounts of a cationic retarder which is adapted as regards exhaustion and migration behaviour to the dye mixtures to be used according to the invention. The process makes possible a simple correction of dyeings which have nevertheless turned out unlevel and permits, in particular, topping at the boil.

The dyeings obtained are further distinguished by good general fastness properties, such as, in particular, wet-fastness properties, such as fastness to washing, water, perspiration, decatizing and steaming.

The cross-sections of fibres dyed with the dye combinations by the process according to the invention have a good dye penetration, which is a fact which aids the level result of a dyeing.

The invention also relates to dyeing combinations which contain at least two dye mixtures, of which each mixture contains (a) at least one migrating cationic dye, the cation weight of which is less than 310, the parachor of which is less than 750 and the log P of which is less than 3.6, and (b) at least one non-migrating cationic dye, at least one parameter of which is outside the definition given under (a).

All the statements made at the outset in connection with the dyeing process hold here analogously.

These dye combinations are, inter alia, also a solid or liquid marketed quality which can be stored without problems for several months at temperatures of minus 20° C. to plus 50° C. The dye combination contains not only the dye mixtures (a) and (b) but also additives which are customary in marketed qualities, such as electrolytes (for example sodium sulfate) and also, if desired, dust-binding agents, water, organic acids, for example acetic acid, and, if desired, further solvents.

These dye combinations can be processed to give any mixture shade desired, by combining, for example, the yellow mixture with the red mixture, the yellow mixture with the blue mixture, the red mixture with the blue mixture or the yellow, red and blue mixture.

The preparation of these dye combinations is effected in a known manner by mixing the respective individual components with one another.

The examples which follow illustrate the invention without restricting it to these. Temperatures are given in degrees centigrade, and percentages denote percentages by weight, based on the weight of fibre material. The dye quantities indicated relate to undiluted material and the retarder quantities to commercially available, i.e. diluted, material.

The colour data are taken from the "COLOUR INDEX HUE INDICATION CHART" of the "Society of Dyers and Colourists, 32–34, Piccadilly, Bradford, England."

EXAMPLE 1

25 kg of polyacrylonitrile yarn (in the form of hanks) are put at 80° and at a liquor ratio of about 1:35 into a Scholl circular dyeing apparatus which contains an aqueous dyeing liquor (about 875 liters) with 0.3% of an aqueous solution of dodecyldimethylbenzylammonium chloride, 2% of acetic acid (80%), 1% of crystalline sodium acetate, 10% of calcined sodium sulfate and a dye combination of 0.72% of dye mixture I and 0.55% of dye mixture II and maintained for 10 minutes at this temperature. The temperature is then raised in the course of about 25 minutes to 102° to 104°, and dyeing is carried out at this temperature for 45 minutes. The liquor is then cooled down, and the goods are rinsed, centrifuged and dried. A polyacrylonitrile yarn is obtained which is dyed perfectly level in a green shade and which has a better light-fastness than a yarn would have, had it been dyed in the same shade but only with migrating dyes.

Dye mixture I:

| Dye | Cation weight | Parachor | log P |
|---|---|---|---|
| 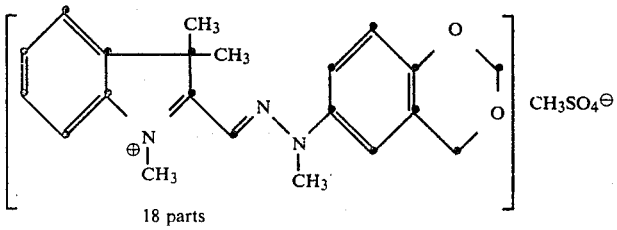 18 parts | 350 | 740 | 5.21 |

The green yarn thus dyed in accordance with Example 1 is treated for 60 minutes at about 104° C. in a fresh bath containing 2% of acetic acid (80%) and 10% of calcined sodium sulfate, together with the same quantity of an undyed identical yarn, the result being a good on tone migration between the dyed and the undyed yarn. This high levelling capacity together with the high lightfastness is not obtained when using non-migrating or migrating cationic dyes on their own.

EXAMPLE 4

48 kg of Dralon weaving yarn on cross-wound packages are put at 80° and at a liquor ratio of about 1:10 into a Krantz cross-wound bobbin apparatus which contains an aqueous dyeing liquor (about 500 liters) with 0.5% of an aqueous solution of dodecyldimethylbenzylammonium chloride, 2% of acetic acid (80%), 1% of crystalline sodium acetate, 10% of calcined sodium sulfate and a dye combination of 0.35% of dye mixture I in accordance with Example 1 and 0.13% of dye mixture II in accordance with Example 1 and 0.1% of dye mixture III, and treated for 5 minutes with the liquor circulating from the inside to the outside. The temperature is then increased in the course of 25 minutes to 104°, and dyeing is carried out for 30 minutes at this temperature. The liquor is then cooled down, and the goods are rinsed, centrifuged and dried. A perfectly levelly dyed brown Dralon yarn is obtained.

Dye mixture III:

| Dye | Cation weight | Parachor | log P |
|---|---|---|---|
| 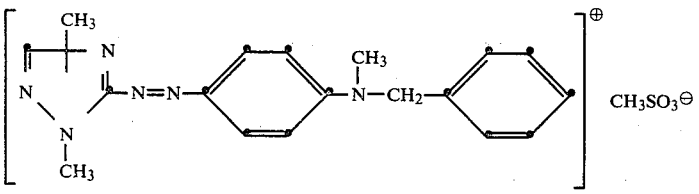 46.9 parts | 321 | 764 | 3.22 |
| 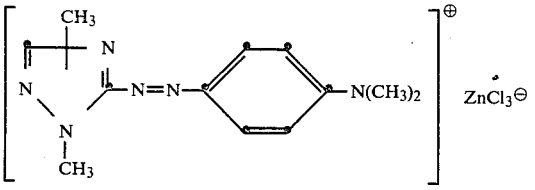 3.1 parts and also 50 parts of sodium sulfate (anhydrous) | 245 | 620 | 1.57 |

The procedure described in Example 4 is repeated, except that the percentages of dye mixtures given in Table 2 which follows are used in place of the indicated amounts of dye mixtures I, II and III, affording the shades on Dralon yarn given in the same table:

TABLE 2

| Example No. | Dye mixture I in % | Dye mixture II in % | Dye mixture III in % | Shade on Dralon |
|---|---|---|---|---|
| 5 | 1.05 | 0.015 | 0.09 | orange |
| 6 | 0.27 | 0.17 | 0.67 | bordeaux |

Example relating to shading

The procedure of Example 4 is repeated using only half the amount of dye mixture III. Instead of a brown shade, an olive shade is obtained which can be shaded as follows:

The dyebath is treated at 104°, via the adding vessel, in the course of 1 to 2 minutes with an aqueous shading additive containing 0.5% of an aqueous solution of dodecyldimethylbenzylammonium chloride and 0.05% of dye mixture III, and dyeing is carried out for 30 minutes at 104°.

A shaded, perfectly level brown-coloured Dralon yarn is then obtained,

EXAMPLE 7

25 kg of polyacrylonitrile yarn (in the form of hanks) are put at 80° and a liquor ratio of about 1:35 into a Scholl circular dyeing apparatus which contains an aqueous dyeing liquor (about 875 liters) with 0.3% of an aqueous solution of dodecyldimethylbenzylammonium chloride, 2% of acetic acid (80%), 1% of crystalline sodium acetate, 10% of calcined sodium sulfate and a dye combination of 0.72% of dye mixture IV and 0.55% of dye mixture II in accordance with Example 1, and is maintained at this temperature for 10 minutes. The temperature is then raised in the course of about 25 minutes to 102° to 104°, and dyeing is carried out at this temperature for 45 minutes. The liquor is then cooled down, and the goods are rinsed, centrifuged and dried. A polyacrylonitrile yarn is obtained which is dyed completely levelly in a brilliant green shade and which has a better light-fastness than a yarn would have, had it been dyed in the same shade but only with migrating dyes.

Dye mixture IV:

| Dye | Cation weight | Para-chor | log P |
|---|---|---|---|
| 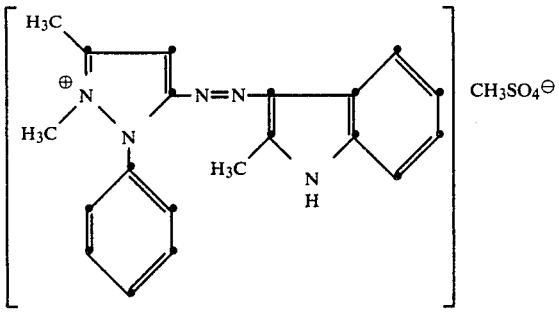 14.6 parts | 330 | 814 | 4.15 |
| 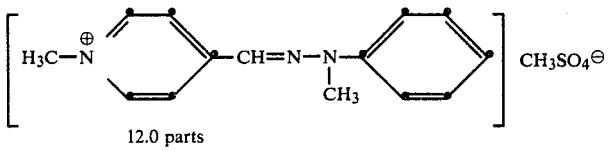 12.0 parts | 226 | 558 | 2.49 |
| 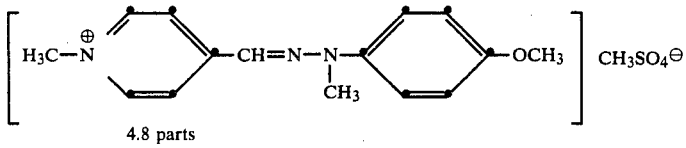 4.8 parts and also 68.6 parts of sodium sulfate | 256 | 618 | 2.49 |

EXAMPLE 8

600 g of polyacrylonitrile yarn wound on perforated, conical steel tubes are put into a Henriksen circulation dyeing apparatus. Beforehand, the dyeing apparatus was filled with an aqueous dyeing liquor (8 liters) containing 2% of acetic acid (80%), 1% of crystalline sodium acetate, 10% of calcined sodium sulfate and a dye combination of 1.1% of dye mixture I, in accordance with Example 1, 0.4% of dye mixture II, likewise in accordance with Example 1, and 0.08% of dye mixture III, in accordance with Example 4. The liquor ratio is about 1:12. The liquor has a starting temperature of 80° C. The dyebath is left at this temperature for 5 minutes after the dyeing goods have been put in it.

The temperature is then raised in the course of 25 minutes to 104° C., and dyeing is carried out for 45 minutes at this temperature. The liquor is then cooled down to 60° C.; the dyed yarn is removed from the dyeing apparatus, rinsed, centrifuged and then dried.

A fault-free, level olive dyeing is obtained which has a Xenon test light-fastness of 6 (as measured by the blue scale).

Polyacrylonitrile yarn is dyed in the same shade, except that only the migrating dyes of the formulae

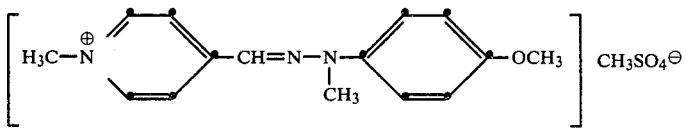

(1)

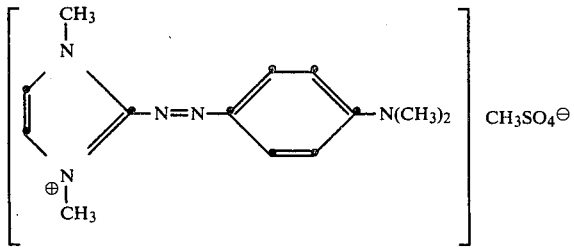

(2)

-continued (3)

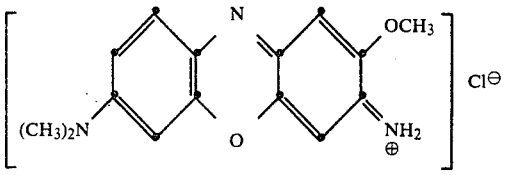

are used, in the following concentrations: 1.2% of dye (1), 0.115% of dye (2) and 0.3% of dye (3), affording a dyeing, the Xenon test light-fastness of which is evaluated to be only 4.

Polyacrylontrile yarn is dyed with dye mixtures I to III as described in Example 8, except that these mixtures are used in the concentrations given in Table 3 which follows, affording a beige or bluish grey dyeing, the light-fastness of which is given in the last column of the table.

TABLE 3

| Example No. | Dye mixture in % I | II | III | Shade on Dralon | Light-fastness |
|---|---|---|---|---|---|
| 9 | 0.48 | 0.21 | 0.12 | beige | 6 |
| 10 | 0.12 | 0.4 | 0.06 | bluish grey | 6–7 |

Also in this case, polyacrylonitrile yarn is dyed for comparison, with the migrating dyes of the formulae (1) to (3) in the corresponding beige or bluish grey shade. Dyeings are obtained the light-fastness of which is given in the final column of Table 4 which follows.

TABLE 4

| Dye concentrations in % (1) | (2) | (3) | Shade on Dralon | Light-fastness |
|---|---|---|---|---|
| 0.5 | 0.15 | 0.14 | beige | 4 |
| 0.105 | 0.085 | 0.32 | bluish grey | 4–5 |

EXAMPLE 11

106 kg of a polyacrylontrile fabric are put at 80° C. and at a liquor ratio of about 1:20 into a Thies R jet dyeing machine which contains an aqueous dyeing liquor (about 2,100 liters) with 2% of acetic acid (80%), 10% of calcined sodium sulfate, 0.2% of an aqueous solution of dodecyldimethylbenzylammonium chloride and 0.7% of dye mixture V and 0.1% of dye mixture VI, and is maintained at this temperature for 5 minutes. The temperature is then increased at a heating rate of 1° C./minute to 105° C., and dyeing is carried out at this temperature for 45 minutes. The liquor is then cooled down to 60° C. at a rate of 2° C./minute, and the dyed fabric is removed from the dyeing machine, rinsed, dewatered and dried. A perfectly level, well penetrated pale olive polyacrylonitrile fabric is obtained which has a high light-fastness and highly satisfactory fastness to steaming.

Dye mixture V:

| Dye | Cation weight | Para-chor | log P |
|---|---|---|---|
| 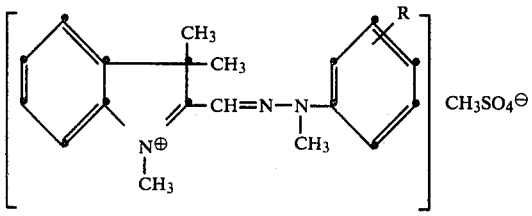 24.2 parts, R = p-$OCH_3$ | 322 | 740 | 5.78 |
| 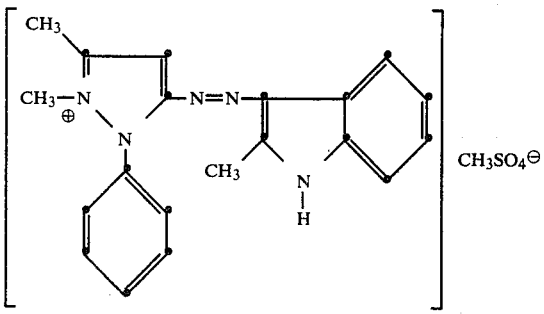 7.8 parts | 330 | 814 | 4.15 |

-continued

Dye mixture V:

| Dye | Cation weight | Parachor | log P |
|---|---|---|---|
| 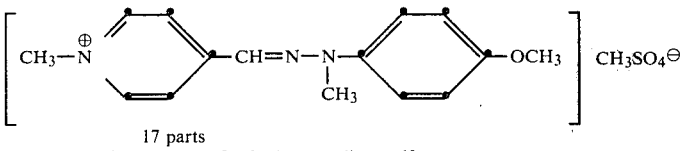 17 parts and also 51 parts of anhydrous sodium sulfate | 256 | 618 | 2.49 |

Dye mixture VI:

| Dye | Cation weight | Parachor | log P |
|---|---|---|---|
| 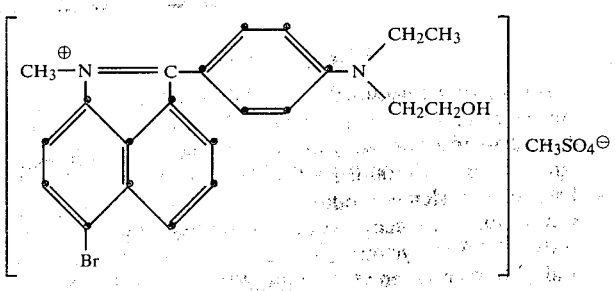 38 parts | 410 | 672 | 5.97 |
| 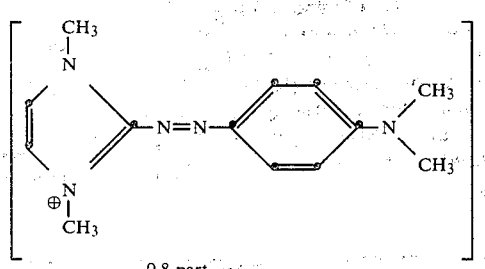 0.8 part | 244 | 610 | 2.68 |
| 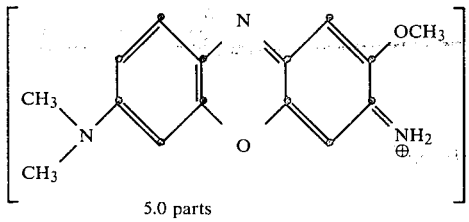 5.0 parts | 270 | 577 | 1.97 |
| 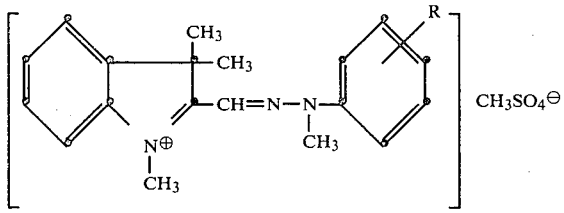 2.8 parts R = p-$OCH_3$ and also 53.4 parts of anhydrous sodium sulfate | 322 | 740 | 5.78 |

We claim:

1. A process for the level di- and trichromatic dyeing of polyacrylonitrile materials or of blended yarns containing polyacrylonitrile, which process comprises using for the dyeing an aqueous dyeing liquor which contains at least two dye mixtures, each dye mixture consisting of at least (a) one migrating cationic dye, the cation weight of which is less than 310, the parachor of which is less than 750 and the log P of which is less than 3.6, and (b) one non-migrating cationic dye, at least one parameter of which is outside the definition given under (a), and using the components (a) and (b) in a mixing ratio which is such that during the dyeing process the migrating and non-migrating dyes migrate on the fibre on tone.

2. A process according to claim 1, wherein three dye mixtures are used, each dye mixture consisting of at least (a) one migrating cationic dye, the cation weight of which is less than 310, the parachor of which is less than 750 and the log P of which is less than 3.6, and (b) one non-migrating cationic dye, at least one parameter of which is outside the definition given under (a), and the components (a) and (b) being used in a mixing ratio which is such that during the dyeing process the migrating and nonmigrating dyes migrate on the fibre on tone.

3. A process according to claim 1, wherein the aqueous dyeing liquor contains an electrolyte and also, if desired, additives which are customary in dyeing and/or a cationic retarder.

4. A process according to claim 1, wherein under identical conditions in each case the same percentage of the total amount of dye of the dye mixtures, consisting of (a) and (b) used, migrates, and in each case on tone migration takes place.

5. A process according to any one of claims 1 to 4, wherein dyeing is carried out at temperatures of 95° to 120° C. by means of the exhaust method.

6. A process according to claim 5, wherein dyeing is carried out at temperatures of 98° to 110° C. by means of the exhaust method.

7. A dye combination which consists of at least two dye mixtures each of which contains (a) at least one migrating cationic dye, the cation weight of which is less than 310, the parachor of which is less than 750 and the log P of which is less than 3.6, and (b) at least one non-migrating cationic dye, at least one parameter of which is outside the definition given under (a), and the components (a) and (b) are employed in a mixing ratio which is such that during the dyeing process the migrating and non-migrating dyes migrate on the fibre on tone.

8. A dye combination according to claim 7, wherein under identical conditions in each case the same percentage of the total amount of dye of each dye mixture consisting of (a) and (b) migrates on tone.

9. Polyacrylonitrile materials or blended yarns containing polyacrylonitrile, dyed according to the process of any one of claims 1 to 6.

* * * * *

UNITED STATES PATENT AND TRADEMARK OFFICE

CERTIFICATE OF CORRECTION

PATENT NO. : 4,410,332

DATED : October 18, 1983

INVENTOR(S) : Manfred Herrmann, Rico Jenny, and Manfred Motter

It is certified that error appears in the above-identified patent and that said Letters Patent is hereby corrected as shown below:

On the cover page, Column 1, Line 22, the filing date should read--

February 1, 1982 --.

Signed and Sealed this

*Fifteenth* Day of *October 1985*

[SEAL]

*Attest:*

DONALD J. QUIGG

*Attesting Officer*

*Commissioner of Patents and Trademarks—Designate*